US011377853B2

(12) United States Patent
Wood

(10) Patent No.: US 11,377,853 B2
(45) Date of Patent: Jul. 5, 2022

(54) DEBRIS SHIELD SYSTEM FOR WATER RUNOFF GUTTERS AND WATER COLLECTION SYSTEMS

(71) Applicant: Jason Wood, Johnstown, CO (US)

(72) Inventor: Jason Wood, Johnstown, CO (US)

( * ) Notice: Subject to any disclaimer, the term of this patent is extended or adjusted under 35 U.S.C. 154(b) by 0 days.

(21) Appl. No.: 17/163,332

(22) Filed: Jan. 29, 2021

(65) Prior Publication Data

US 2022/0002999 A1 Jan. 6, 2022

Related U.S. Application Data

(60) Provisional application No. 63/047,721, filed on Jul. 2, 2020.

(51) Int. Cl.
*E04D 13/076* (2006.01)
*E04D 13/072* (2006.01)

(52) U.S. Cl.
CPC ..... *E04D 13/076* (2013.01); *E04D 13/0725* (2013.01)

(58) Field of Classification Search
CPC ..... E04D 13/076; E04D 13/0725
USPC ..... 52/12
See application file for complete search history.

(56) References Cited

U.S. PATENT DOCUMENTS 6,598,352 B2 * 7/2003 Higginbotham ..... E04D 13/076 210/474
7,104,012 B1 * 9/2006 Bayram ..... E04D 13/076 219/213
7,191,564 B2 3/2007 Higginbotham
D558,309 S 12/2007 Gregg
7,310,912 B2 * 12/2007 Lenney ..... E04D 13/076 52/12
7,448,167 B2 * 11/2008 Bachman ..... E04D 13/076 219/213
7,650,720 B2 * 1/2010 Ealer, Sr. ..... E04D 13/076 52/12
7,913,458 B2 * 3/2011 Higginbotham .... E04D 13/0765 52/12
8,028,474 B2 * 10/2011 Beck ..... E04D 13/076 52/12
RE42,896 E 11/2011 Higginbotham
8,079,183 B2 * 12/2011 Lenney ..... E04D 13/0762 52/12
RE43,555 E 7/2012 Higginbotham
8,312,677 B2 11/2012 Higginbotham
8,397,436 B2 3/2013 Higginbotham
8,479,454 B2 * 7/2013 Lenney ..... E04D 13/076 52/12
8,495,837 B2 * 7/2013 McCoy ..... E04D 13/076 52/12
8,677,695 B2 3/2014 Mccoy
8,756,868 B2 6/2014 Mccoy
(Continued)

*Primary Examiner* — Adriana Figueroa
(74) *Attorney, Agent, or Firm* — Strategic Patents LLC; Bret W Adams

(57) ABSTRACT

A debris shield system for use with gutters and other water runoff collection systems is disclosed. The debris shield system provides universal fit to various gutter systems and enables easier assembly on-site and simplifies manufacturing. The debris shield system includes various water adhesion and water capture features, which function to slow the flow of water, break surface tension of the water, and encourage the water flow into a gutter or other water runoff system.

14 Claims, 6 Drawing Sheets

(56) References Cited

U.S. PATENT DOCUMENTS

| | | | | |
|---|---|---|---|---|
| 9,181,707 | B2 * | 11/2015 | Iannelli | E04D 13/064 |
| 9,284,735 | B2 * | 3/2016 | Bryer | E04D 13/064 |
| D770,602 | S | 11/2016 | Earler, Sr. | |
| 9,631,369 | B2 | 4/2017 | Cullen | |
| 9,765,525 | B2 | 9/2017 | Hargrow, Jr. | |
| 9,783,988 | B2 | 10/2017 | Bryer et al. | |
| 9,863,150 | B2 * | 1/2018 | Lenney | E04D 13/076 |
| 10,125,496 | B2 * | 11/2018 | Lenney | E04D 13/064 |
| 10,501,940 | B2 * | 12/2019 | Lenney | H05B 3/06 |
| 2005/0204641 | A1 | 9/2005 | Collister et al. | |
| 2006/0179723 | A1 * | 8/2006 | Robins | E04D 13/076 52/11 |
| 2011/0185642 | A1 * | 8/2011 | DeHart, Sr. | E04D 13/076 52/12 |
| 2012/0110922 | A1 | 5/2012 | Hawes | |
| 2012/0144759 | A1 | 6/2012 | Higginbotham et al. | |
| 2012/0222366 | A1 | 9/2012 | Steinberg et al. | |
| 2013/0097943 | A1 | 4/2013 | Higginbotham | |
| 2013/0160377 | A1 * | 6/2013 | Sager | E04D 13/076 52/12 |
| 2014/0069029 | A1 * | 3/2014 | Reese | E04D 13/076 52/12 |
| 2016/0102459 | A1 * | 4/2016 | Breyer | E04D 13/064 52/12 |
| 2019/0234075 | A1 | 8/2019 | Breyer | |
| 2019/0277033 | A1 | 9/2019 | Gori | |

* cited by examiner

DEBRIS SHIELD SYSTEM FOR WATER RUNOFF GUTTERS AND WATER COLLECTION SYSTEMS

CROSS-REFERENCE TO RELATED APPLICATIONS

The present application claims priority to U.S. Provisional Patent Application No. 63/047,721, filed 2 Jul. 2020 and titled "Debris Shield System for Gutters," the full disclosure of which is herein by reference in their entireties for all purposes.

TECHNICAL FIELD

The technology described herein relates to a debris shield for a gutter or other water runoff collection system installed on or proximal to a roof or other location on a building such as a home, office building, and the like.

BACKGROUND

It is common for buildings to have gutter and water runoff mitigation systems extending around the perimeter of the roof to capture and redirect rain water to a location where the water can be properly drained away from the property and to prevent runoff onto walkways and entryways. However, in addition to rainwater, debris may collect on the roof and be blown into or carried by the rainwater into the gutter system. Debris may include leaves, branches, twigs, dirt, pinecones, and the like. Since gutter systems are primarily designed to carry and redirect water, debris may build up causing the gutter system to become blocked.

To help alleviate this problem, devices have been developed which are designed to cover the opening of the gutter and allow water to pass through the cover and into the gutter while keeping larger debris out. However, the better a cover is at keeping debris out, the worse it is at allowing water to infiltrate through the cover and into the gutter. This can result in water running over the edge of the gutter and onto the ground, causing potential safety hazards such as slick walkways or ice buildup, and defeating the purpose of the gutter system. Conversely, if a cover is developed which allows water to infiltrate easily, it can also inadvertently allow debris to enter the gutter system, causing clogs and other blockages over time. Accordingly, a system is needed which allows water reliably to infiltrate the gutter cover while preventing debris from entering the gutter system and preventing water from simply "tracking" over the gutter cover and off the edge of the roof and gutter system.

The information included in this Background section of the specification, including any references cited herein and any description or discussion thereof, is included for technical reference purposes only and is not regarded subject matter by which the scope of the invention as defined in the claims is to be bound.

SUMMARY

The present disclosure has been developed to remedy the deficiencies of existing debris shield systems.

A debris shield system of the present disclosure is designed for use with gutters and other water runoff collection systems. The debris shield system provides universal fit to various gutter systems and enables easier assembly on-site and simplifies manufacturing. The debris shield system includes various water adhesion and water capture features, which function to slow the flow of water, break surface tension of the water, and encourage the water flow into a gutter or other water runoff system.

In one example, the present disclosure is directed to a debris shield system for preventing debris buildup in a gutter, comprising: a gutter cap having a body with a first dimension extending along the first direction of the gutter cap and a second dimension, orthogonal to the first dimension, extending along a second direction of the gutter cap, comprising: one or more ridges formed integrally with the body and provided on a first side, the one or more ridges extending along the second direction and configured to impede a fluid flow occurring substantially along the first dimension; one or more ribs provided on a second side opposite the first side and formed integrally with the body; a plurality of apertures formed through the body and extending between the first side and the second side; a coupling portion configured to cooperate with an interface of a roof coupler; wherein the roof coupler further comprises a channel formed by the interface and configured to receive the coupling portion and to removably and securely couple the roof coupler to the body; and wherein the plurality of apertures are configured to permit the fluid flow to pass therethrough.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments of the invention and illustrated in the accompanying drawings.

DETAILED DESCRIPTION

General Overview

Figure 1:
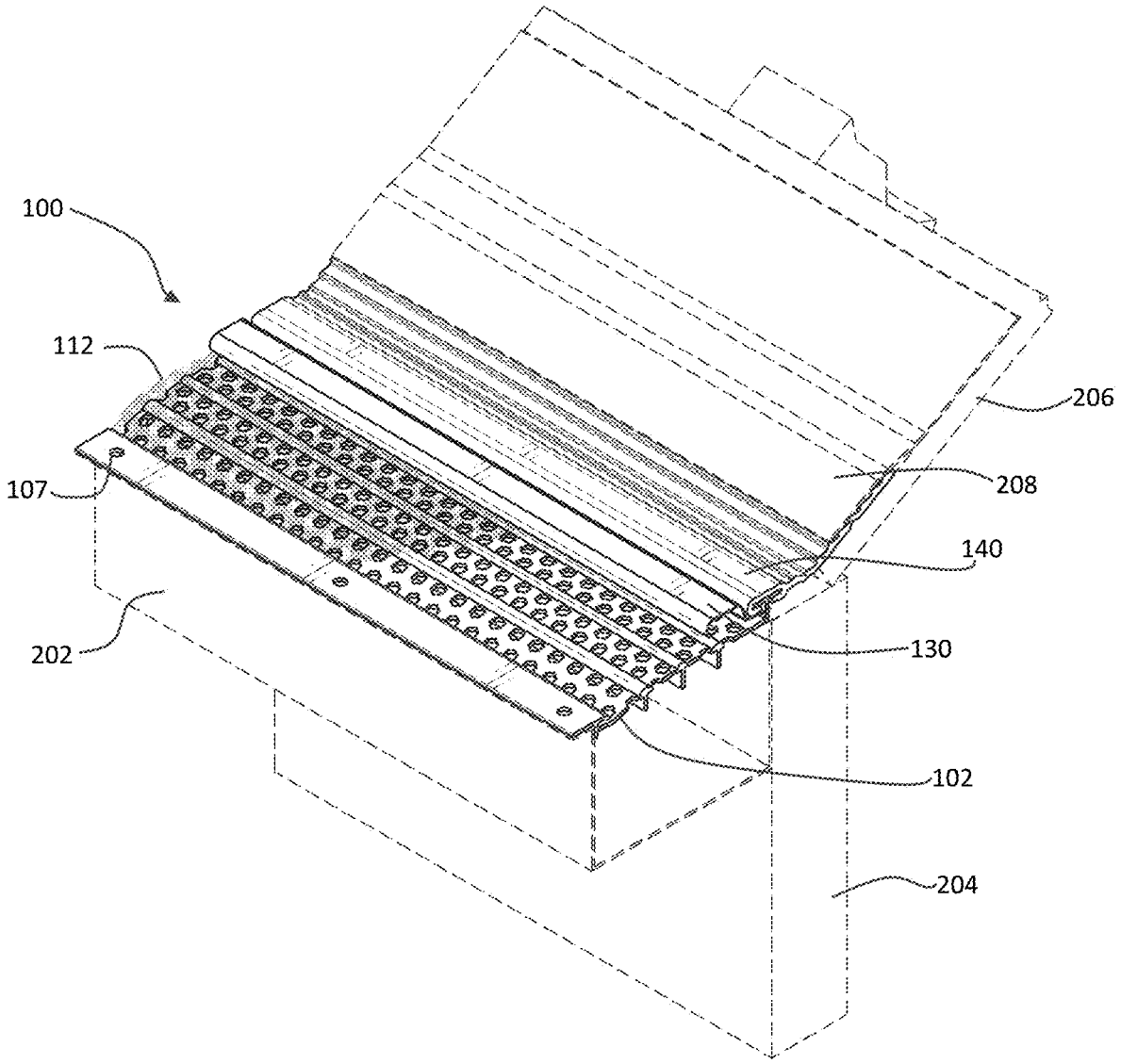
FIG. 1 is a perspective view of the debris shield system for gutters installed on an exemplary section of a gutter.

As discussed above in the background section, debris shield systems are designed to cooperate with building gutter systems to prevent debris and detritus from entering the gutter or other water runoff collection system while allowing water to pass through the debris shield into the gutter. The debris shield system of the present disclosure includes several novel features designed to capture more water runoff into the runoff collection system while keeping debris from building up on the debris shield itself, or entering the runoff collection system itself.

In particular, several water adhesion features are provided in the debris shield system which are designed to slow down the flow of water down so that it can be better captured by the gutter system, while preventing debris from passing through the debris shield or accumulating on top of the shield. The debris shield system includes three main components: a gutter cap, a screen overlaying the gutter cap, and a roof coupler. Additional components, like a deicer cap and a heat cable, may optionally provided. The gutter cap and roof coupler may be provided as individual pieces to allow easier, customized installation while also simplifying manufacturing by allowing components to be individually molded, extruded, or formed by different materials while also allowing for future changes to be easily made to one piece without affecting the manufacture of the other. To aid in the slow-down of the runoff water flow, and encourage collection of water into the gutter or other runoff collection system, the gutter cap and roof coupler may be provided with one or more water adhesion features.

The gutter cap may have a several apertures extending through the cap which allow water to pass through to the gutter. A screen, such as a micromesh, a finely-woven stainless steel micro-filter, and the like, may optionally be inserted into a portion of the gutter cap and overlay. The screen may designed to allow water to pass therethrough while keeping debris from entering through the gutter cap apertures into the water runoff or gutter system. Further, the screen may also encourage the debris to be directed off the edge of the gutter system.

The roof coupler may include several ridges and a coupler interface designed to slow the water flow from the rooftop or other section of a building (e.g., a deck). The roof coupler ridges, which may be shaped like a sawtooth or a shark's dorsal fin, also function to prevent water from infiltrating under the shingles of the roof while helping to retain the roof coupler under the shingles. These ridges may also be referred to as anti-wicking ridges. The roof coupler interface, which receives a portion of the gutter cap when assembled, is designed with a curved shape selected such that the surface tension of water allows the water to "adhere" to the roof coupler interface, slowing the flow of water down and directing it onto the gutter cap. It is noted that "adhere" is used with respect to the present disclosure to describe a situation where the surface tension or other cohesive forces of water has become dominant and the water flows substantially on the surface of the component. That is, the water will substantially follow curves and angles of the surface as if it were adhesively coupled to said surface. Optionally, a deicer cable cover may be provided which has a similarly curved shape as the roof coupler interface, and may include adhesion features, to capture the water flow and encourage the water to pass through the gutter cap.

The gutter cap may have several ridges on the top side which extend along the length of the gutter cap (i.e., wherein the length is the longer dimension extending along the side of the roof and the building, generally orthogonal to the width or smaller dimension of the gutter itself). The gutter cap ridges, similar to the curved shape of the roof coupler interface, are designed to slow down and capture the water flow, encouraging it to flow into and pass through the gutter cap apertures. On an under side of the gutter cap, several ribs are provided which extend along the length of the gutter cap, extending in the same general direction as the gutter cap ridges. These ribs are provided both as a structural support to increase longevity of the gutter cap and to make installation easier, but the ribs also perform as water adhesion features. In particular, as water passes through the apertures of the gutter cap, it may "track" or adhere to an underside of the cap. In addition to providing structural rigidity for the gutter cap, the ribs are designed to prevent this water from tracking the entire underside of the gutter cap in instead impacts the ribs which force it down into the gutter. Furthermore, the ribs may enable the gutter cap to be installed at a greater angle (that is, a more inclined angle relative to horizontal) which further reduces buildup of debris on the top of the gutter cap.

The third main component of the debris shield system is a screen which generally overlays the top of the gutter cap. The screen may be a micromesh screen, finely woven stainless steel microfilters, or other screen provided with holes small enough to keep debris out while allowing water to pass through. The screen is designed to be substantially the same width as the gutter cap and extend along the length of the gutter cap. The screen is formed so that it is in contact with the ridges formed on the upper surface of the gutter cap, as illustrated in the Figures. This is desirable because in some situations, such as heavy water flow, some water may not be able to immediately enter through the small holes in the screen and may "track" over the top of the screen. By forming the screen and gutter cap ridges so that the screen contacts the ridges and other portions of the gutter cap, the amount of water which is captured by the debris shield system is significantly improved. For example, water may impact the portion of the screen overlaying and in contact with the first, second, or third ridge (or additional ridges if provided), slow down from this impact, and fall through the screen and the gutter cap where it can then enter the gutter for normal disposal by the gutter system.

DESCRIPTION OF PREFERRED EMBODIMENTS

Figures illustrating examples of the present disclosure will now be discussed. Reference numbers amongst the various figures depict common features and components between the various views.

The term "adhere" is used with respect to the present disclosure to describe a situation where the surface tension, adhesion, or cohesion of water has become dominant and the water flows substantially on the surface of the component such that the water substantially follows curves, contours, shapes, and angles of the component as if it were adhesively coupled to or "stuck" to said surface. In some examples when the water is "adhered" to the surface in this manner it may exhibit a capillary action. In some examples this process may be conceptualized or described as the water "sticking" to the surface of the components of the present disclosure. Similarly, the term "tracking" may be used to describe the flow of water when it is adhered to a surface or a component or a feature.

With reference to FIG. 1, a perspective view of the debris shield system (DSS) 100 according to the present disclosure is illustrated in partial cross-section with a pre-existing gutter 202 on a building 204 having a roof 206 and shingles 208. The gutter 202 may be any type of water runoff collection system, but for the purpose of this discussion will be referred to simply as a gutter 202. The DSS 100 comprises a gutter cap 102 configured to be coupled to and partially recessed in the gutter 202. The cap 102 may be secured to the gutter 202 by a fastener such as a screw, nail, and the like (not shown) extending through the apertures 107 and into a portion of the gutter 202. When installed on a gutter 202, a screen 112 may optionally overlays the top of the cap 102. The screen 112, such as a micromesh or finely woven stainless steel microfilter, may cover all or only a portion of the cap 102 in either the length or width directions. During installation, some sections of the cap 102 may not be provided with a screen, such as in high-flow areas such as sections of a gutter system which collect significant water runoff like roof corners and the like.

A roof coupler 140 may include an interface 142 forming a channel 146 which cooperates with a male coupling portion 106 provided on a proximal side of the cap 102, such that the channel 146 mates with the proximal portion of the cap 102. This two-piece design may allow for easier installation, while also allowing multiple sizes and shapes of roof couplers 140 to be used with multiple sizes and shapes of caps 102, which in turn provides a more adaptable fit for a variety of water runoff systems. A portion of the roof coupler 140 may extend under the shingles 208 (or similar roof covering) of the roof 206, as illustrated in FIG. 1. Flex point 149 may also allow the roof coupler 140 to easily bend to accommodate various widths of gutters as well as enable attachment of the roof coupler 140 to fascia board of the building 204. An optional electric deicing heat cable 136 and deicer cover 130 may be provided at a proximal end of the cap 102. By providing the deicer cover 130 at the proximal end of the cap 102, as opposed to the distal end nearby the flange 104, debris buildup caused by the deicer cover 130 can be prevented. Deicer cover may also promote increased contact between the screen 112 and the cap 102, if a screen is provided. Heat cable 136 may be substantially any conventional configuration that is compatible with the size and shape of the deicer cover 130.

Figure 2:
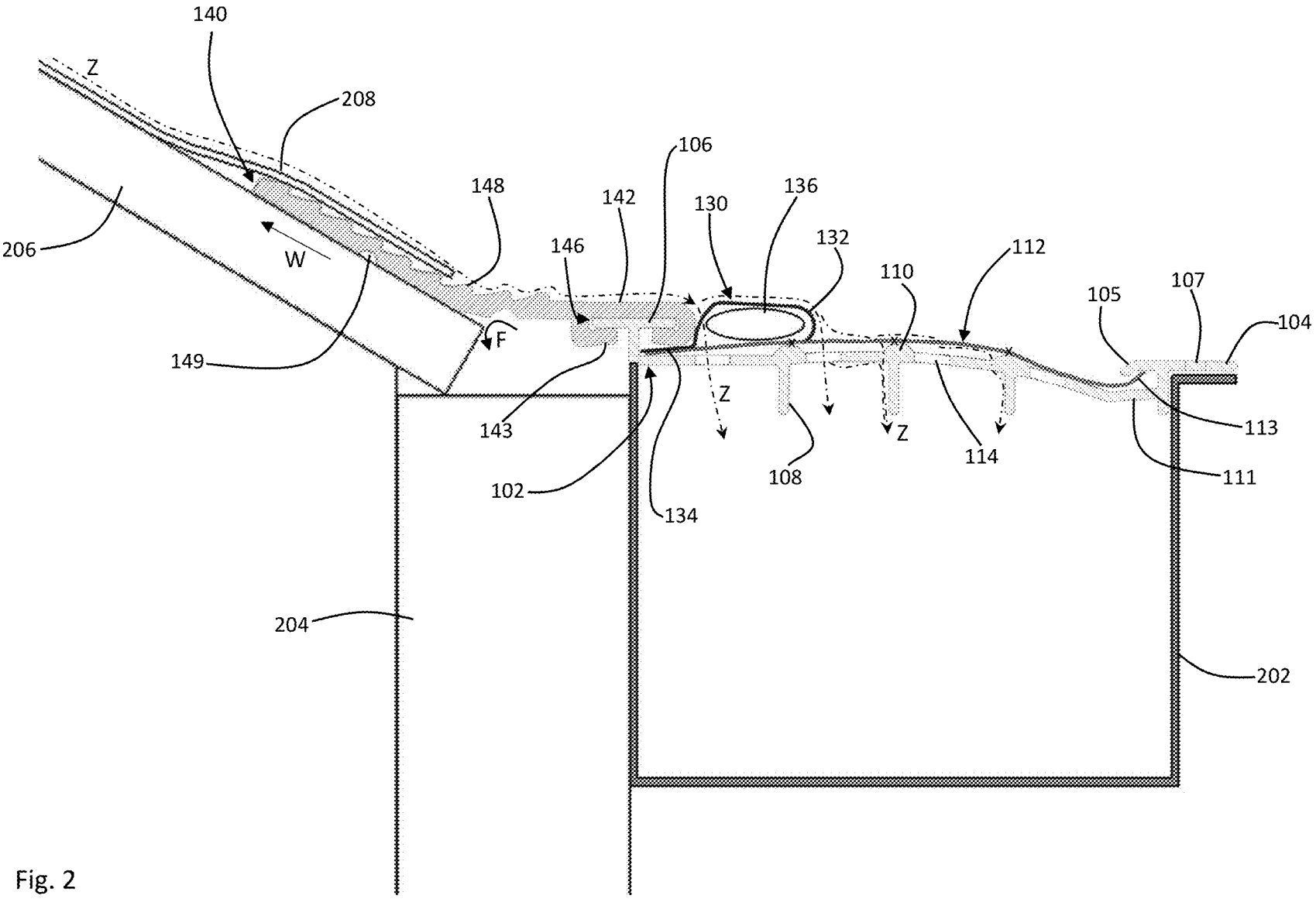
FIG. 2 is a side cross-sectional view of the system of FIG. 1.

Turning now to FIG. 2, a side cross-sectional view of the debris shield system 100 is illustrated. As discussed above, the debris shield system 100 has several water adhesion features which provide a significant improvement over other solutions to gutter clogged by debris build-up. The adhesion features, such as the cap ridges 110, cap ribs 108, curved edge 144 of the roof coupler interface 142, roof coupler ridges 148, and/or the curved edge 132 of the (optional) heat cable cover 130, may operate to slow the flow Z (illustrated in dashed line in the Figures) of water down such that the water may adhere (as discussed above) to the respective components of the debris shield system 100. By this adhesion or capillary action, a significant portion of the water flow Z may be encouraged into the gutter 202.

The gutter cap 102, also referred to as cap 102, maybe formed from a metal or plastic material, and may preferably be formed of a light weight, rigid metal such as aluminum. A flange 104 having one or more through-holes or apertures 107 extending therethrough is provided at the distal end of the cap 102. The apertures 107 may allow a fastener such as a nail or screw (not shown) to secure the flange 104 to a gutter 202, thereby coupling the gutter cap 102 to the gutter 202 and securing it in place.

Also at the distal end of the cap 102, a screen retention finger 105 may be provided. The screen 112 (if provided) may fit under this retention finger 105 which is configured to assist in retaining the screen 112 (if provided) in contact with portions of the cap 102. In some examples, the distal end of the screen may also include a retention member 113, which may be a folded-back portion of the screen 112 or may alternatively be a separate component coupled to or integrally formed with the screen 112.

Figure 3:
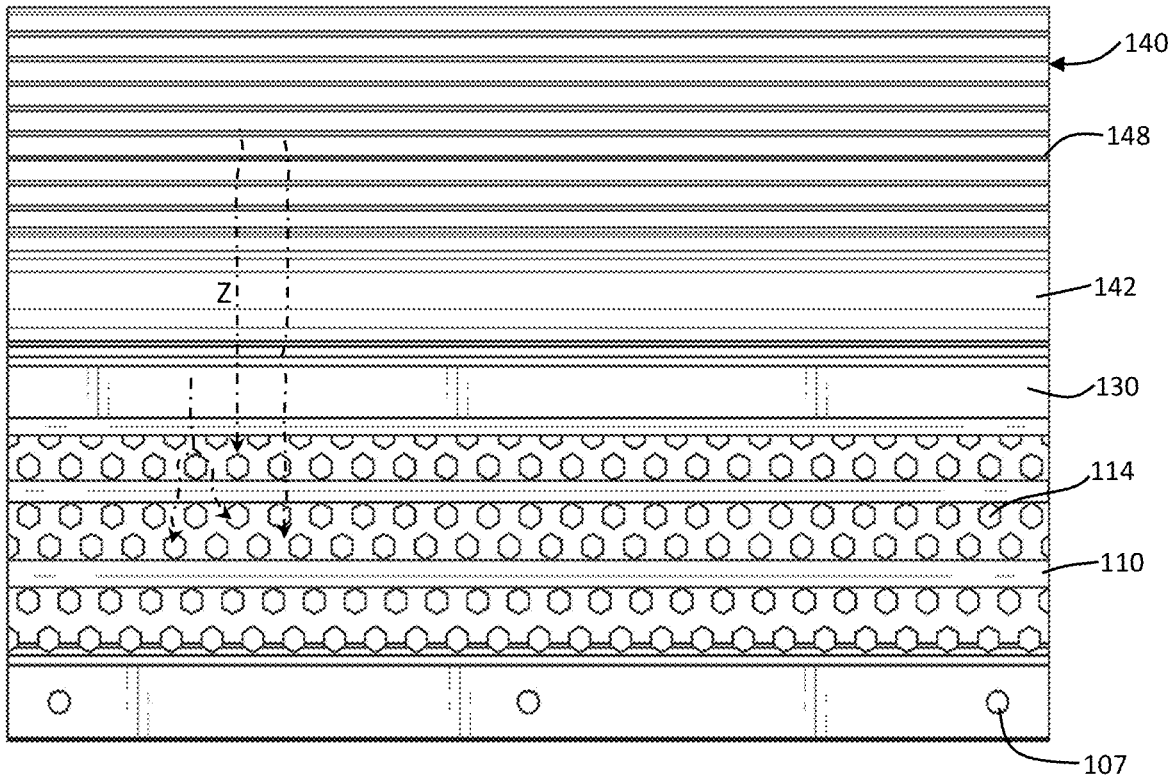
FIG. 3 is a top view of the debris shield system of FIG. 1.
Figure 4:
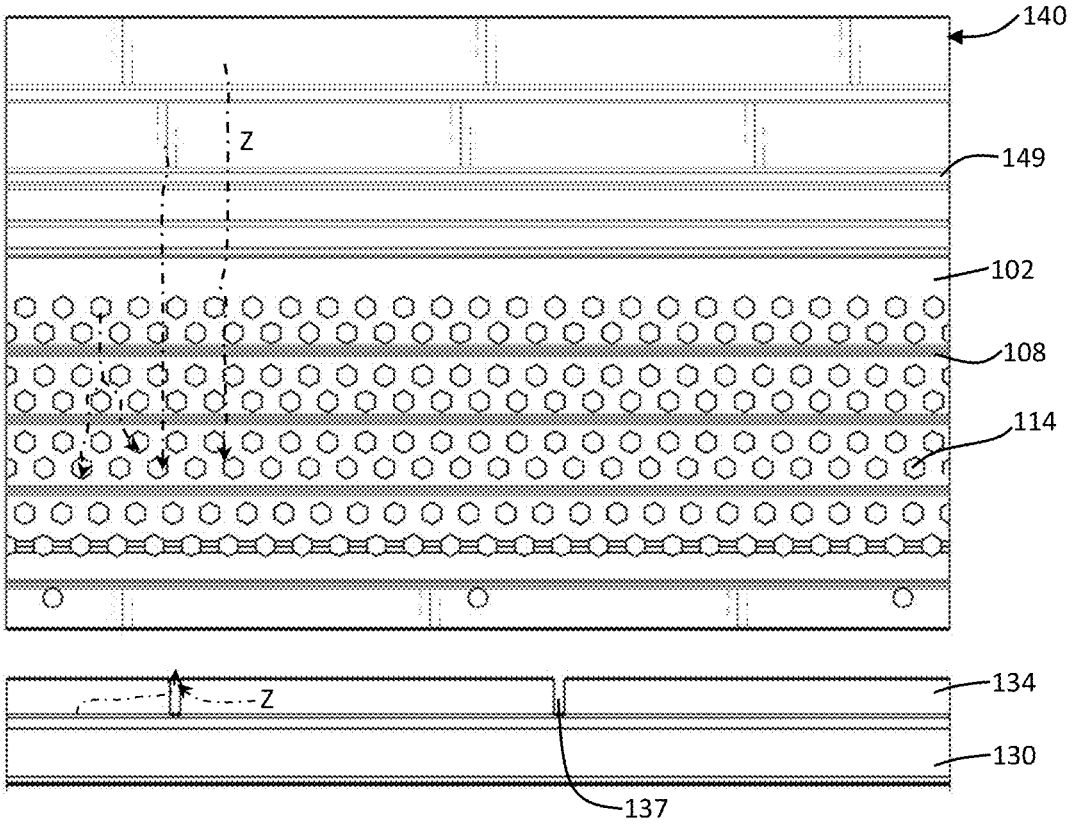
FIG. 4 is a bottom view of the debris shield system of FIG. 1.

As illustrated in FIG. 2, the cap 102 may be formed with a slight curve in it such that a proximal end (i.e., where the coupling portion 106 is provided) is elevated above the distal end (i.e., where the fastening flange 104 is provided), as shown in FIG. 2. This curved, geodesic, or parabolic shape encourages debris and water flow Z to flow substantially down and away from the roof 206 and shingles 208. A plurality of apertures 114 (see also FIGS. 3-5), are provided extending through the surface of the cap 102. These apertures 114 allow water to pass through the cap 102 and to flow into the gutter 202. As shown in FIGS. 3-4, the aperture 114 may be formed in a hexagonal shape with one of the vertices or corners of the hexagon confronting the flow of water Z. This specific design and layout, with a corner of the hexagon substantially confronting the direction Z of flow of water runoff functions to break the surface tension of the water flow and encourages water to be drawn into the apertures 114 and into the gutter 202. Furthermore, the apertures 114 may be provided in rows which are offset in a length direction (e.g., orthogonal to the water flow Z illustrated in FIG. 3). That is, one row of apertures 114 may be offset from the previous row such that water flow Z which "misses" or skips over one aperture 114 may be captured by the following row of apertures 114.

One or more ridges 110 may be provided on an upper surface of the cap 102. These ridges 110 extend along the length of the cap 102 as shown in FIG. 3, and protrude above the surface of the cap 102 to form curved "bump" shaped surface, akin to a speed bump on a road. These ridges 110 operate to slow the water flow Z down, which assists with adhering the water to the surface of the cap 102 and encouraging water to fall through the apertures 114 as discussed above.

As shown in FIG. 2, when assembled on the cap 102, the screen 112 (if provided) may have several contact points with the ridges 110. Since the screen is provided with small openings to allow water to flow through while blocking debris such as leaves, trimmings, branches, and the like, these openings in the screen 112, due to their small size, may also allow the water to "track" or flow over the top surface and/or track under the bottom surface the screen 112. By ensuring that portions of the screen 112 contact the ridges 110 during installation, these contact points (denoted by small "x" in FIG. 2) provide paths for the water flow Z to impact the cap 102, drop through the screen and flow through apertures 114 into the gutter 202.

On an under side of the cap 102 one or more ribs 108 may be provided. The ribs 108 may in some examples be substantially planar or rectangular in shape, extending downward into the interior volume of the gutter 202 (see FIG. 2). However, these ribs 108 may take on various other shapes other than rectangular or planar, and may have a tapered, chamfered, triangular, or other geometrical shape. Ribs 108 may provide improved rigidity to the cap 202, making it easier to install and handle while retaining the shape as designed and depicted. In addition to structural rigidity, which is also improved by the formation of the ridges 110 on the upper surface, the ribs 108 also function as water adhesion features. As water enters through the apertures 114 of the cap 102 as discussed above, instead of the water flow Z passing into the gutter 202 in some instances a portion of the water flow may adhere or track on an under surface of the cap 102. In this instance, the ribs 108 function to impede water flow from extending the whole width of the cap 102, and instead any tracking water is forced to drop into the gutter 202. Furthermore, ribs 108 may enable the gutter cap 102 to be installed at a greater angle on the gutter 202, which further reduces buildup of debris on the top of the gutter cap. That is, a more inclined angle relative to horizontal such that the proximal end with coupling portion 106 of the cap 102 is elevated above the distal end with the flange 104 of the cap 102 (i.e., more elevated than illustrated in FIG. 2). The ribs 108, in such an increasingly inclined implementation, function to capture any water flow which tracks the under side of the cap 102 and force the water into the gutter 202.

At a proximal end of the cap 102 a coupling portion 106 is provided formed to securely couple the cap 102 with a roof coupler 140. In some examples, the coupling portion 106 may be formed in a substantially "T" shape with flanges extending in directions distal and proximal (i.e., substantially orthogonal to the length direction of the cap 102) from the roof coupler 140. This coupling portion 106 may cooperate with the channel 146 a roof coupler 140 interface 142. The interface 142 of the roof coupler 140 may have fingers 143 formed with a shape which creates a channel 146 for receiving the T-shape of the coupling portion 106 of the cap 102, as shown in FIG. 2. It is noted that although discussed as having a substantially T-shape, the coupling portion 106 of the cap 102 may be formed with other configurations which allow reversibly coupling the cap 102 and roof coupler 140, such as an "L" shape interface with a flange extending only to one side and a matching channel in the coupler 140, a snap-fit connection, a tongue-in-groove interface, and the like, without departing from the scope of the present disclosure.

In the present example, when assembling the debris shield system 100, the T-shaped coupling portion 106 may be slid into the channel 146 of the roof coupler 140. This two-piece design simplifies the manufacturing and installation of the debris shield system 100, while enabling the use of a roof coupler 140 with different sizes, shapes, materials, and designs, while retaining compatibility with the gutter cap 102. This increased compatibility may also allow for variously sized caps 102 to be used such that compatibility with various gutter sizes, roof designs, and the like, may be accommodated. This adaptability enables a more universal fit for the wide variety of gutter systems, other water runoff systems, and various structural designs of buildings and roofs.

The roof coupler 140, in addition to being compatible with various types of roofing designs and gutter sizes, is also designed to encourage water to enter the gutter 202. For example, the roof coupler 140 interface 142 may include a curved edge 144 which is designed with a radius of curvature which promotes water adhesion on the distal end of the roof coupler 140 interface 142, thereby ensuring more water falls onto the screen 112 (if provided) and cap 102. In this way, the curved edge 144 may operate as an additional adhesion feature as discussed above.

The roof coupler 140 may also include plural ridges 148 on an upper surface of the roof coupler 140. These ridges 148, similar to ridges 110 provided on the cap 102, operate to slow the water flow Z down, which is important for promoting adhesion. As shown in FIGS. 1 and 2, in some examples not all ridges 148 will be under a shingle 208, and as water flows from the rooftop it will impact one or more of the ridges 148. As discussed above, the ridges 148 may also prevent water from seeping "upward" (e.g., seeping in a proximal direction toward the end of the roof coupler 140 provided under the shingles 208). Additionally, ridges 148 also function to keep the roof coupler 140 positioned under the shingles 208 or other roof covering by providing a ridged or ribbed surface which increases the frictional fit of the roof coupler 140 under the shingle 208.

Roof coupler 140 may also be provided with flex points 149 on a side opposite the ridges 148. The flex points 149 allow the roof coupler 140 to bend and flex to fit the contours of the shape and angle of the roof 206 and/or shingles 208. Further, the flex points 149 allow the roof coupler 140 to be "folded" back onto itself in the direction indicated by arrow F in FIG. 2, and as discussed above. Flex points 149, by virtue of their thinner construction relative to the other parts of the heat coupler 140, may also allow portions of the heat coupler 140 to be removed (e.g., by cutting, slicing, or ripping) to further improve compatibility with a variety of gutter systems. In some implementations of the debris shield system 100, the width of the gutter 202, the shape and size of the roof 206, and/or design of the shingles 208 may necessitate portions of the roof coupler 140 to have a smaller overall size so that the debris shield system 100 may better fit together with the gutter 202 or roof 206. For example, if a gutter has a width greater than the width of the cap 102, the roof coupler may be folded back in a L-shape or U-shape as needed to allow the overall width of the debris shield system 100 to be increased beyond the width of the cap 102. In such an example, the proximal (e.g., folded) portion roof coupler 140 may be coupled to a portion of the gutter or to a portion of the building as needed.

Figure 6A:
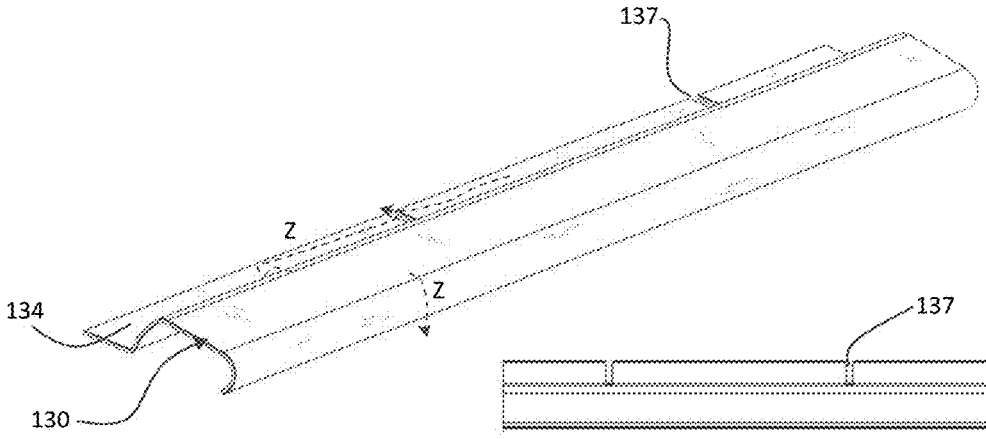
FIG. 6A is an isolated perspective view of the heat cable cover of the system of FIG. 1
Figure 6B:
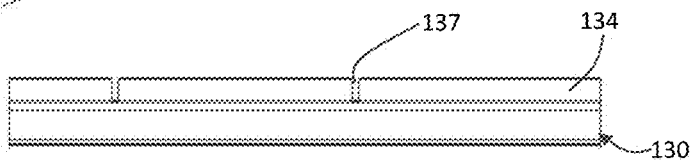
FIG. 6B is an isolated bottom view of the heat cable cover of the system in FIG. 1.

The deicer cover 130, if provided, is designed to integrate with the debris shield system 100, as illustrated best in FIGS. 1, 2, and 6. The deicer over 130 may slide underneath the distal finger 143 of the roof coupler 104 interface 140. The lower lip of the distal curve 132 of the deicer cover 130 may impact the top of the cap 102 or the screen 112, thereby encouraging the screen 112 (if provided) to contact the ridges 110 of the cap 102 and thereby provide points for water flow Z to adhere to the cap 102 and drop into the gutter, as discussed above. In addition to securing the deicer cover 130 to the debris shield system 100 by a frictional fit, the proximal surface 134 of the deicer cover 130 may be sloped to encourage any water flow which seeps in between the deicer cover 130 and the curved section 144 of the interface 140 to flow distally on the proximal surface 134 and into one or more slots 137 (see FIGS. 4 and 6) provided on the proximal surface 134. In this manner, water buildup on the surface 134 is reduced and additional water flows onto the cap 102 and into the gutter via apertures 114. Deicer cover 130 may also increase the contact area between the heat cable 136 and the metal screen 112 and gutter cap 102, improving the heating of these elements and melting any ice that is built up on the cap 102, screen 112, and roof coupler 140. In implementations where the cap 102 is made of metal, such as aluminum, the heat generated by the heat cable 136 may conduct through the width and length of the cap 102 to improve deicing.

Figure 5A:
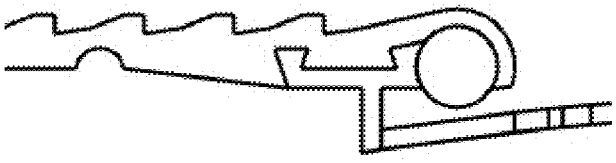
FIGS. 5A, 5B, 5C, and 5D illustrate alternate examples of interface configurations between roof coupler components and gutter caps.
Figure 5B:
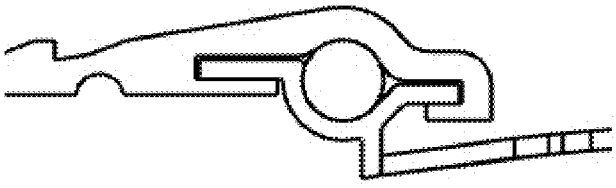
Figure 5C:
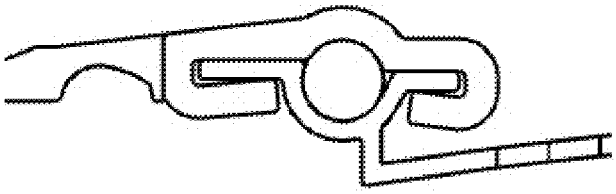
Figure 5D:
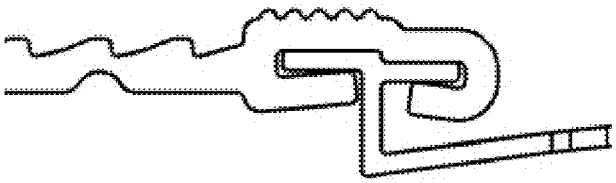

FIGS. 5A-5D illustrate alternative designs of the roof coupler 140, interface 142, channel 146, and coupling portion 106. In the example of FIGS. 5A-5C, a deicer cable cover has been integrated with the roof coupler 140. In FIG. 5D, additional ridges have been provided on a top surface of the roof coupler interface 142 which may function to slow water flow down, break surface tension, and encourage collection of the water into the gutter as discussed above.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present invention, and do not create limitations, particularly as to the position, orientation, or use of the invention. Connection references (e.g., attached, coupled, connected, and joined) may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order, and relative sizes reflected in the drawings attached hereto may vary.

The above specification, examples and data provide a complete description of the structure and use of exemplary embodiments of the invention as defined in the claims. Although various embodiments of the claimed invention have been described above with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

The invention claimed is:

1. A debris shield system for preventing debris buildup in a gutter, comprising:

a gutter cap having a, substantially planar body having an upper surface, the bed having a first dimension extending along the first direction of the gutter cap and a second dimension, orthogonal to the first dimension, extending along a second direction of the gutter cap, the gutter cap comprising:

one or more ridges formed integrally with the body and protruding from the upper surface, the one or more ridges extending along the second direction and configured to impede a fluid flow occurring substantially along the first dimension;

one or more ribs protruding from a bottom surface opposite the upper surface and formed integrally with the body;

a plurality of apertures formed through the body and extending between the upper surface and the bottom surface;

a coupling portion configured to cooperate with an interface of a roof coupler;

wherein the roof coupler further comprises a channel formed by the interface and configured to receive the coupling portion and to removably and securely couple the roof coupler to the body; and wherein the plurality of apertures are configured to permit the fluid flow to pass therethrough.

2. The debris shield system of claim 1, wherein the roof coupler further comprises one or more sawtooth ridges configured to impede fluid flow occurring along the first direction.

3. The debris shield system of claim 2, wherein one or more flex points are provided on a surface opposite the sawtooth ridges.

4. The debris shield system of claim 1, wherein the roof coupler further comprises one or more flex points configured to allow a proximal end of the roof coupler to fold about the one or more flex points.

5. The debris shield system of claim 1, wherein each of the plurality of apertures are formed in a substantially hexagonal shape, and wherein a first portion of the plurality of apertures is provided on a first row and a second portion of the plurality of apertures is provided in a second row offset from the first row in a first direction and a second direction.

6. The debris shield system of claim 1, wherein the body further comprises a retention mechanism at a distal end of the body.

7. The debris shield system of claim 6, wherein the retention mechanism is configured to retain a micromesh screen in contact with at least a portion of the body.

8. The debris shield system of claim 6, wherein a surface opposing the retention mechanism is provided at an angle such that fluid flow is urged along a first direction and toward the proximal end of the body.

9. The debris shield system of claim 1, further comprising a screen with a plurality of micromesh apertures configured to allow the passage of fluid flow.

10. The debris shield system of claim 9, wherein the screen is further configured to abut the one or more ridges on the body.

11. The debris shield system of claim 1, further comprising a deicer cap coupled to a proximal end of the body.

12. The debris shield system of claim 11, wherein the deicer cap comprises an angled surface configured to provide a frictional fit with the interface of the roof coupler.

13. The debris shield system of claim 11, wherein the deicer cap further comprises one or more slots on a proximal surface thereof, the one or more slots configured to allow passage of the fluid flow.

14. A water runoff collection system for a building, the water runoff collection system comprising:

a roof of the building;

a gutter having a gutter body forming an interior volume and provided proximal to the roof, the gutter configured to collect a fluid flow from the roof into the interior volume;

a debris shield system comprising:

a gutter cap having a, substantially planar body having an upper surface, the body having a first dimension extending along the first direction of the gutter cap and a second dimension, orthogonal to the first dimension, extending along a second direction of the gutter cap, the gutter cap comprising:

one or more ridges formed integrally with the body and protruding from the upper surface, the one or more ridges extending along the second direction and configured to impede a fluid flow occurring substantially along the first dimension;

one or more ribs protruding from a bottom surface opposite the upper surface and formed integrally with the body;

a plurality of apertures formed through the body and extending between the first side and the second side;

a coupling portion configured to cooperate with an interface of a roof coupler;

wherein the roof coupler further comprises a channel formed by the interface and configured to receive the coupling portion and to removably and securely couple the roof coupler to the body; and wherein the debris shield system is configured to permit the passage of fluid flow through the plurality of apertures and into the interior volume.

* * * * *